US010166434B2

(12) United States Patent
Caccia

(10) Patent No.: US 10,166,434 B2
(45) Date of Patent: Jan. 1, 2019

(54) EXERCISE BIKE

(71) Applicant: Alexander Caccia, Oxford (GB)

(72) Inventor: Alexander Caccia, Oxford (GB)

(73) Assignee: Alexander Caccia, Oxford (GB)

( * ) Notice: Subject to any disclaimer, the term of this patent is extended or adjusted under 35 U.S.C. 154(b) by 44 days.

(21) Appl. No.: 15/039,181

(22) PCT Filed: Nov. 25, 2014

(86) PCT No.: PCT/GB2014/053484
§ 371 (c)(1),
(2) Date: May 25, 2016

(87) PCT Pub. No.: WO2015/079217
PCT Pub. Date: Jun. 4, 2015

(65) Prior Publication Data

US 2017/0136293 A1 May 18, 2017

(30) Foreign Application Priority Data

Nov. 26, 2013 (GB) ..... 1320823.6

(51) Int. Cl.
*A63B 22/06* (2006.01)
*A63B 69/16* (2006.01)
(Continued)

(52) U.S. Cl.
CPC ..... *A63B 22/0605* (2013.01); *A63B 21/225* (2013.01); *A63B 22/0046* (2013.01);
(Continued)

(58) Field of Classification Search
CPC ..... A63B 22/06–22/0694; A63B 22/0041–22/0048; A63B 21/225;
(Continued)

(56) References Cited

U.S. PATENT DOCUMENTS 7,582,044 B2 * 9/2009 M gica Miguel ..... A63B 69/16 482/57
7,927,258 B2 * 4/2011 Irving ..... A63B 21/015 482/51
(Continued)

FOREIGN PATENT DOCUMENTS

CN 1 90 975 A 1/2007
TW M 407 769 U 7/2011
(Continued)

OTHER PUBLICATIONS

International Search Report and Written Opinion for PCT/GB14/53484, dated Feb. 3, 2015.
(Continued)

*Primary Examiner* — Garrett Atkinson
(74) *Attorney, Agent, or Firm* — Womble Bond Dickinson (US) LLP; John J. Perry, Jr.

(57) ABSTRACT

An exercise bike comprising: a base; a frame having a head tube; and a steering stem mounted in the head tube, and operable to be rotatable about the longitudinal axis of the stem by a user, wherein a lower part of the frame is pivotally mounted to the base to allow rotation of the frame, relative to the base, about a substantially horizontal axis, wherein a first resilient mounting is provided between the frame and the base, and a second resilient mounting is provided between the steering stem and the base, the first and second resilient mountings, together, configured to bias the frame towards a substantially upright position relative to the base, the second resilient mounting further configured to urge the stem substantially into rotational alignment with a predetermined point on the base.

13 Claims, 2 Drawing Sheets

(51) Int. Cl.
*A63B 21/22* (2006.01)
*A63B 22/00* (2006.01)

(52) U.S. Cl.
CPC ..... *A63B 69/16* (2013.01); *A63B 2022/0641* (2013.01); *A63B 2069/162* (2013.01); *A63B 2069/164* (2013.01); *A63B 2208/0233* (2013.01); *A63B 2225/093* (2013.01)

(58) Field of Classification Search
CPC ..... A63B 2225/093; A63B 2208/0233; A63B 2069/164
USPC ..... 482/57–65
See application file for complete search history.

(56) References Cited

U.S. PATENT DOCUMENTS 8,092,352 B2 * 1/2012 Irving ..... A63B 21/225 482/57
8,845,493 B2 * 9/2014 Watterson ..... A63B 22/02 482/1
2005/0209064 A1 * 9/2005 Peterson ..... A63B 22/16 482/61
2007/0072744 A1 * 3/2007 Badarneh ..... A63B 26/003 482/57
2007/0087909 A1 * 4/2007 Mugica Miguel ..... A63B 69/16 482/57
2009/0048076 A1 * 2/2009 Irving ..... A63B 21/015 482/57
2009/0170667 A1 * 7/2009 Irving ..... A63B 21/225 482/57
2011/0172059 A1 * 7/2011 Watterson ..... A63B 22/02 482/5
2011/0195820 A1 * 8/2011 Irving ..... A63B 21/015 482/57
2012/0108399 A1 * 5/2012 Irving ..... A63B 21/225 482/57

FOREIGN PATENT DOCUMENTS

WO 2005/046806 A2 5/2005
WO 2007/055584 A1 5/2007
WO WO 2007/055584 * 5/2007 ..... A63B 22/08
WO 2011/002302 A2 1/2011

OTHER PUBLICATIONS

Search Report dated Apr. 11, 2014, for United Kingdom Application No. GB 1320823.6.

* cited by examiner

EXERCISE BIKE

CROSS-REFERENCE TO RELATED APPLICATIONS

This application is a national stage entry of International Application No. PCT/GB2014/053484, filed on Nov. 25, 2014, which claims priority to GB 1320823.6, filed on Nov. 26, 2013, each of which is hereby incorporated by reference in its entirety.

The present invention relates to an exercise bike.

The frame of a conventional exercise bike is fixed relative to its base. A conventional exercise bike therefore only replicates the spinning dynamic forces associated with peddling a bike. It does not simulate any of the lateral dynamic forces experienced by a user when peddling a bike. Notably, a conventional exercise bike does not allow the user to articulate the bike from side to side, nor to rotate the handlebars.

Articulating exercise bikes have previously been suggested, including that disclosed in US2012/0108399. However, the mechanism of such bikes is complicated and does not adequately simulate riding a bike.

Accordingly, the present invention provides an exercise bike comprising: a base; a frame having a head tube; and a steering stem mounted in the head tube, and operable to be rotatable about the longitudinal axis of the stem by a user, wherein a lower part of the frame is pivotally mounted to the base to allow rotation of the frame, relative to the base, about a substantially horizontal axis, wherein a first resilient mounting is provided between the frame and the base, and a second resilient mounting is provided between the steering stem and the base, the first and second resilient mountings, together, configured to bias the frame towards a substantially upright position relative to the base, the second resilient mounting further configured to urge the stem substantially into rotational alignment with a predetermined point on the base.

Preferably, the frame is pivotally mounted to the base by the first resilient mounting.

Advantageously, the first resilient mounting has a different resiliency to the second resilient mounting.

Conveniently, the resiliency of the second mounting is adjustable.

Preferably, the first resilient mounting comprises two resilient bushes.

Advantageously, each resilient bush comprises an inner ring and an outer ring, with a resilient member secured therebetween.

Conveniently, the base further comprises a substantially horizontal support bar and the frame comprises a bottom bracket shell, the inner ring of each resilient bush being secured to the support bar, the outer ring of the first resilient bush being secured to the bottom bracket shell, the outer ring of the second resilient bush being journalled to the lower distal end of the steering stem.

Preferably, the base comprises a riser extending upwards from the base, and the second resilient mounting is connected between the steering stem and the riser.

Advantageously, the steering stem and the riser are substantially parallel to one another.

Conveniently, the riser and steering stem are angled with respect to the vertical.

Preferably, the second resilient member is a resilient cord,

Advantageously, the resilient cord is configured to be substantially horizontal when the frame is in a substantially upright position relative to the base.

Conveniently, the exercise bike further comprises a drive mechanism and associated fly wheel.

Embodiments of the present invention will now be described, by way of example only, with reference to the accompanying figures in which.

Figure 1:
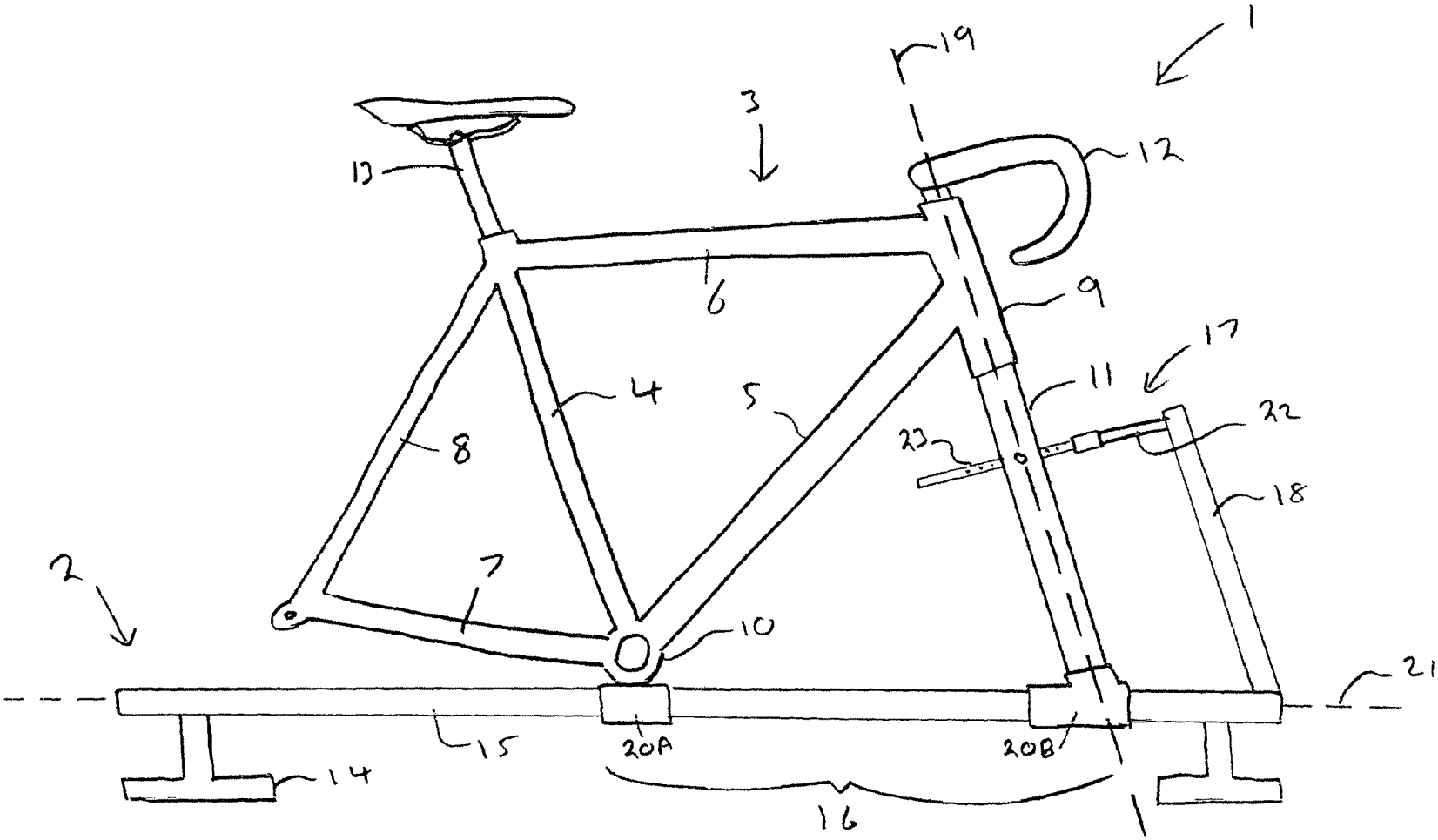
FIG. 1 illustrates an exercise bike embodying the present invention.

FIG. 1 shows an exercise bike 1 embodying the present invention, comprising a base 2 and a frame 3. The frame 3 comprises a seat tube 4, down tube 5 and top tube 6. The seat, down and top tubes 4, 5, 6 are connected to one another so as substantially to define a triangle. The frame 3 further comprises chain stays 7 (one of which is illustrated) and seat stays 8 (one of which is illustrated). The tubes 4, 5, 6 and stays 7, 8 are arranged in a conventional "double diamond" bike frame configuration. The configuration and features of the frame in FIG. 1 are preferable but not essential. It is to be understood that other types of bike frame are suitable for use with the invention, including but not limited to step-through, cantilever, recumbent, prone, cross, truss, monocoque, folding and tandem style frames.

The frame 3 further comprises a head tube 9 attached at one end of the top tube 6 and down tube 5. The head tube 9 is of conventional construction, comprising a generally cylindrical tube with a through-bore. Bearings may additionally be provided.

A bottom bracket shell 10 is provided at the intersection of the chain stays 7, seat tube 4 and down tube 5.

A steering stem 11 is mounted in the head tube 9 and operable to be rotatable about the longitudinal axis 19 of the stem 11 by a user. A handle-bar 12 is attached to the top of the steering stem 11, allowing a user to rotate the steering stem 11 in use.

The base 2 comprises a substantially horizontal support bar 15. Feet 14 are attached to the support bar 15 (shown schematically in FIG. 1). Additionally, a riser 18 is attached at one end of the support bar 15.

A lower part of the frame 3 is pivotally mounted to the base 2 to allow rotation of the frame 3, relative to the base 2, about a substantially horizontal axis 21. A first resilient mounting 16 is provided between the frame 3 and the base 2. A second resilient mounting 17 is provided between the steering stem 11 and the base 2.

The first resilient mounting 16 preferably comprises two resilient bushes 20*a*, 20*b*.

Each resilient bush 20*a*, 20*b* comprises an inner ring and an outer ring, with a resilient member secured therebetween. In FIG. 1, only the outside surface of the outer ring of each resilient bush 20*a*, 20*b* is illustrated. Preferably, the resilient member is substantially ring shaped. The outer surface of the resilient member is secured to the inner surface of the outer ring; and the inner surface of the resilient member is secured to the outer surface of the inner ring. As the outer ring is rotated relative to the inner ring, about a longitudinal axis of the resilient bush 20*a*, 20*b*, the resilient bush secured therebetween progressively resists the rotational movement and urges the inner and outer rings back to their relative rotational starting position. Preferably, the inner and outer surfaces of the resilient bush are substantially cylindrical. Alternatively, they may be substantially curved, elliptical, spherical etc.

The first resilient bush 20*a* is attached to a lower surface of the bottom bracket shell 10. Accordingly, the outer ring of the first resilient bush 20*a* is fixed relative to the frame 3.

In use, the first resilient bush 20*a* serves to bias the frame 3 into a substantially upright position (i.e. vertical assuming that the base 2 is arranged substantially horizontally). The frame 3, base 2, and first resilient bush 20*a* are configured such that, in its resting position, the plane of the frame 3 is substantially perpendicular to the surface on which the base 2 is resting.

The second resilient bush 20*b* is of similar construction to the first resilient bush 20*a*. The lower end of the steering stem is rotationally attached (journalled) to the outer ring of the second resilient bush 20*b*.

In an alternative embodiment, the head tube 9 may extend further than shown in FIG. 1, and be rigidly attached to the outer ring of the second resilient bush 20*b*. Connection between the steering stem 11 and the riser 18 of the base 2 may be through a window in the extended head tube 9. The arrangement illustrated in FIG. 1 is preferred since it allows the use of a conventional bike frame 3.

The first and second resilient bushes 20*a*, 20*b* together define a first resilient mounting 16. That is to say, the respective resilient members within each of the first 20*a* and second 20*b* resilient bushes together act to resist any rotation of the frame 3, relative to the base 2, about a substantially horizontal axis 21.

In the arrangement illustrated in FIG. 1, the resilient bushes 20*a*, 20*b* rotate about an axis which is coaxial with the longitudinal axis of the horizontal support bar 15; and the horizontal support bar 15 is substantially cylindrical.

Figure 2:
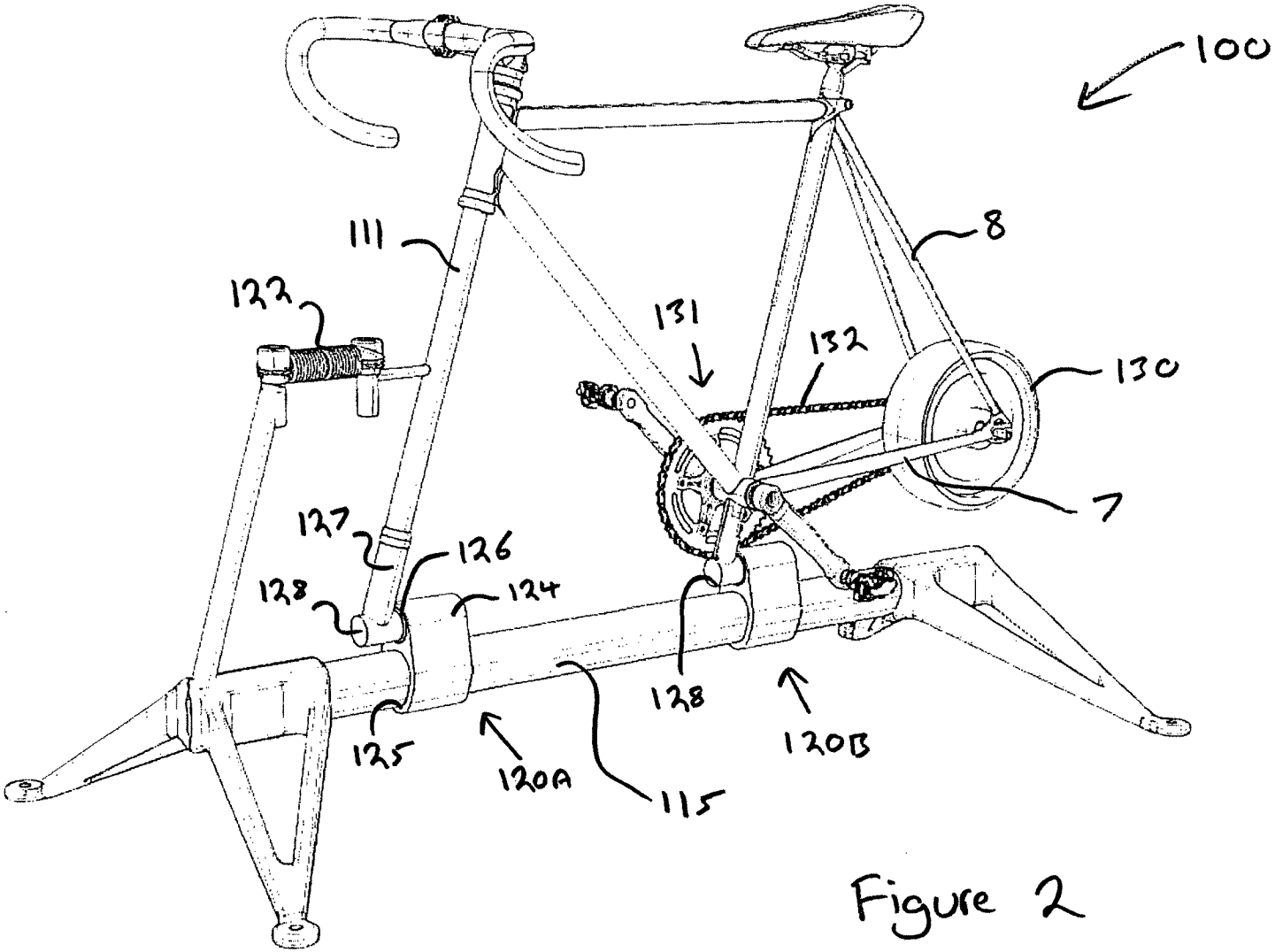
FIG. 2 illustrates another exercise bike embodying the present invention.

FIG. 2 illustrates an alternative embodiment 100, comprising a resilient bush assembly 120A, 120B, which comprises a main body having a boss 124 extending therefrom. The main body comprises an aperture 125 which receives the horizontal support bar 115. In the embodiment illustrated, the aperture 125 and the support bar 115 are non-circular, such that relative rotation of the main body about the longitudinal axis of the support bar 115 is prevented.

The boss 124 comprises a cylindrical aperture 126. The lower end of the stem 11 is journalled to a lower mounting member 127. The mounting member 127 includes an arm 128 which is rotatably received within the aperture 126 of the boss 124. A resilient member is received between the arm 128 and the aperture 126, to create a resilient bushing, preferably secured to both the arm 128 and the aperture 126. The resilient member secured therebetween progressively resists the rotational movement and urges the aperture back to its starting position relative to the boss 124.

A further arm 128 is rigidly secured to a bracket extending from the bottom bracket shell 10, and receivable in the resilient bush assembly 120B.

It will be noted that the arm 128 rotates around a horizontal axis which is parallel to, but offset from, the longitudinal axis of the horizontal support bar 115. Conveniently, the extent of any torsional forces on the support bar 115 are reduced as compared to the arrangement illustrated in FIG. 1.

In the embodiment 100 of FIG. 2, a spring 122 is provided in place of the resilient resilient cord 22 of FIG. 1. Both the spring 122 and resilient cord 22 perform the same function, by providing a resilient member.

Alternatively, the first resilient mounting 16 may comprise only a single resilient bush. Alternatively, a second resilient bush may be secured to another part of the frame, for example one of the chain stays 7.

The first resilient mounting 16 may comprise a single elongate resilient bush. The bottom bracket shell 10 may be attached to one end of the outer ring of the single resilient bush, and the bottom of the steering stem 11 may be journalled to the other end of the outer ring of the single resilient bush.

In another embodiment, not shown, the inner ring of the second resilient bush 20*b* (or of the single resilient bush in an alternative embodiment) may extend to the right, as shown in FIG. 1, and protrude beyond the end of the outer ring. The lower end of the riser 18 may be secured to the outer surface of the inner ring. Conveniently, this arrangement would allow for the exercise bike 1 to be collapsed, by allowing rotational movement between the inner ring of the bush(es) and the support bar 15 of the base 2. The inner ring of the bush(es) may be releasably locked to the support bar 15 in use.

Additionally, an exercise bike 1 embodying the present invention provides a second resilient mounting 17 provided between the steering stem 11 and the base 2. More specifically, the second resilient mounting 17 is secured between the steering stem 11 and the top portion of the riser 18.

The riser 18 and steering stem 11 are substantially parallel to one another. Preferably, the riser 18 and steering stem 11 are angled with respect to the vertical. The second resilient member 17 preferably comprises a resilient cord 22 and adjusting mechanism 23. In the arrangement shown, the adjusting mechanism 23 comprises a rod which passes through an aperture in the steering stem 11. The rod may translate within the aperture in the steering stem 11, and be locked into place with a pin (not shown). One end of the resilient cord is secured to the end of the rod, and the other end of the resilient cord 22 is secured to the top of the riser 18. By translating the rod relative to the steering stem 11, the tension, and thus the resiliency of the resilient cord 22 can be adjusted. Alternatively, there may not be an adjusting mechanism. The resilient cord may be fixed at its respective ends to the top of the riser 18 and the steering stem. Alternatively, a plurality of resilient cords may be provided to a user, each of a different length and/or resiliency. Alternatively, a plurality of substantially identical resilient cords may be provided, wherein a number of cords are arranged together in parallel to create a composite resilient cord of a desired resiliency.

As the steering stem 11 is rotated about the longitudinal axis 19, the end of the rod of the adjusting mechanism 23 is caused to prescribe an arc. In so doing, since the riser 18 is fixed relative to the base 2, the rotation of the steering stem 11 causes the resilient cord 22 to stretch. The resiliency of the resilient cord 22 progressively resists any further rotation of the steering stem 11. The resilient cord 22 effectively urges the steering stem 11 into substantial rotational alignment with the top of the riser 18 (such that the rod and resilient cord 22 are substantially co-axial).

In use, when a user rotates the steering stem 11, using the handle bars 12, in either direction, the second resilient mounting 17 progressively resists that steering motion, and urges it back into a "home" position.

Additionally, when the frame 2 is rotated, relative to the base, about the horizontal axis 21, a tensile force will be imparted on the resilient cord 22 by that rotation. Accordingly, as the frame 3 is tilted off the vertical, the tensile force created in the resilient cord 22 will cause the steering stem 11 to rotate about its longitudinal axis 19.

For example, with reference to the figure, if a user, when sitting on the seat 13, tilts the frame 3 to the right hand side (when facing forward), the tensile force created in the resilient cord 22 will cause the steering stem 11 to rotate anticlockwise. In other words, the handle bars 12 would turn to the left.

This motion more closely simulates the behaviour of a conventional bicycle when being ridden.

When the frame 3 is tilted relative to the vertical, the resiliency of the resilient cord 22 also contributes to the biasing force which urges the frame back to the vertical position. However, in a preferred embodiment, the resilient members within the first 20*a* and second 20*b* resilient bushes contribute the majority of the biasing force.

Although a resilient cord 22 is shown in FIG. 1, any other form of resilient member may be used. For example, a spring may be secured between the steering stem 11 and riser 18.

As illustrated in FIG. 2, but equally applicable to all embodiments, a flywheel 130 is attached to the rear of the frame 3, at the intersection of the chain stays 7 and seat stays 8. The flywheel 130 is connected by a conventional chain 132 to a conventional pedal arrangement 131 mounted in the bottom bracket shell 10. The flywheel 130 may comprise a solid flywheel, or a wheel with a variable resistance mechanism. Suitable gearing may also be provided. The feet 14 of the base 2 are preferably high enough so as to allow full rotation of the pedal crank without impacting upon the floor.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. An exercise bike comprising:

a base;

a frame having a head tube; and a steering stem mounted in the head tube, and operable to be rotatable about the longitudinal axis of the stem by a user, wherein a lower part of the frame is pivotally mounted to the base to allow rotation of the frame, relative to the base, about a substantially horizontal axis, wherein a first resilient mounting is attached to the frame and the base, the first resilient mounting comprising: a first component having an aperture, a second component configured to be rotatably received within the aperture, and a resilient member disposed between the first component and the second component, and a second resilient mounting is attached to the steering stem and the base, the first and second resilient mountings, together, configured to bias the frame towards a substantially upright position relative to the base, the second resilient mounting further configured to urge the stem substantially into rotational alignment with a predetermined point on the base.

2. An exercise bike according to claim 1, wherein the frame is pivotally mounted to the base by the first resilient mounting.

3. An exercise bike according to claim 1, wherein the first resilient mounting has a different resiliency to the second resilient mounting.

4. An exercise bike according to claim 1, wherein the resiliency of the second mounting is adjustable.

5. An exercise bike according to claim 1, wherein the first resilient mounting comprises two resilient bushes.

6. An exercise bike according to claim 5, wherein each resilient bush comprises an inner ring and an outer ring, with a resilient member secured therebetween.

7. An exercise bike according to claim 6, wherein the base further comprises a substantially horizontal support bar and the frame comprises a bottom bracket shell, the inner ring of each resilient bush being secured to the support bar, the outer ring of the first resilient bush being secured to the bottom bracket shell, the outer ring of the second resilient bush being journalled to the lower distal end of the steering stem.

8. An exercise bike according to claim 1, wherein the base comprises a riser extending upwards from the base, and the second resilient mounting is connected between the steering stem and the riser.

9. An exercise bike according to claim 8, wherein the steering stem and the riser are substantially parallel to one another.

10. An exercise bike according to claim 8, wherein the riser and steering stem are angled with respect to the vertical.

11. An exercise bike according to claim 1, wherein the second resilient member is a resilient cord.

12. An exercise bike according to claim 11, wherein the resilient cord is configured to be substantially horizontal when the frame is in a substantially upright position relative to the base.

13. An exercise bike according to claim 1, further comprising a drive mechanism and associated fly wheel.

* * * * *